US006030270A

United States Patent [19]

Krog

[11] Patent Number: 6,030,270

[45] Date of Patent: Feb. 29, 2000

[54] TOY BUILDING ELEMENT WITH ROTATABLY CONFIGURED COUPLING MEANS

[75] Inventor: Ricco Reinholdt Krog, Vejen, Denmark

[73] Assignee: INTERLEGO AG, Baar, Switzerland

[21] Appl. No.: 09/040,486

[22] Filed: Mar. 18, 1998

[51] Int. Cl.[7] ..... A63H 33/08

[52] U.S. Cl. ..... 446/102; 446/126

[58] Field of Search ..... 446/102, 103, 446/126, 104; 403/52, 53, 169, 217

[56] References Cited

U.S. PATENT DOCUMENTS

| | | | |
|---|---|---|---|
| 566,053 | 8/1896 | Benson | 403/169 |
| 2,099,209 | 11/1937 | Hufferd | 403/52 |
| 2,170,771 | 8/1939 | Benjamin | 446/126 |
| 2,410,874 | 11/1946 | Greenberg et al. | 446/126 |
| 2,410,875 | 11/1946 | Segal | 446/126 |
| 2,438,548 | 3/1948 | Ehmann | 403/169 |
| 2,661,177 | 12/1953 | Hofer | 403/53 |
| 2,683,329 | 7/1954 | Kobler . | |
| 3,236,004 | 2/1966 | Christiansen | 446/102 |
| 3,415,008 | 12/1968 | Fischer | 446/104 |
| 3,566,530 | 3/1971 | Fischer | 446/104 |
| 4,044,497 | 8/1977 | Bettens . | |
| 4,430,826 | 2/1984 | Ryaa . | |
| 4,758,196 | 7/1988 | Wang | 446/126 |

FOREIGN PATENT DOCUMENTS

| | | | |
|---|---|---|---|
| 625982 | 7/1949 | United Kingdom | 403/53 |

*Primary Examiner*—Sam Rimell
*Assistant Examiner*—Jeffrey D. Carlson
*Attorney, Agent, or Firm*—Pitney, Hardin Kipp and Szuch LLP

[57] ABSTRACT

A toy building element (1) comprising a central portion (2) provided with at least one coupling means (3, 4) arranged axially relative to the central portion (2). Furthermore, the toy building element comprises at least one other coupling means (5, 6) arranged radially relative to the central portion (2), the at least one further coupling means (5, 6) being so arranged that it is able to rotate in excess of 360° about the central portion (2).

7 Claims, 1 Drawing Sheet

TOY BUILDING ELEMENT WITH ROTATABLY CONFIGURED COUPLING MEANS

The invention relates to a toy building element comprising a central portion provided with at least one coupling means arranged axially relative to the central portion, said toy building element further comprising at least one second coupling means arranged radially relative to said central portion.

Such toy building element is known from U.S. Pat. No. 4,044,497 that discloses i.a. a connector element for bar-shaped toy building elements. The connector element is cubic and all of its six surfaces are provided with protruding male coupling means in the form of square, undercut heads that may engage with complementary openings provided in the elongate toy building elements. This toy building element can be used if it is desired to construct three-dimensional structures since the elongate toy building elements may be interengaged with the connector element in three orientations perpendicular to each other.

U.S. Pat. No. 4,044,497 also teaches a toy building element in the form of a hinge that consists of a first U-shaped portion with protruding male coupling means on the three sides and a second portion that may hingedly engage with the first portion between the legs of the U and which is also provided with a protruding male coupling means. Thus, the entire toy building element consists of two portions that are rotatable relative to each other about a central axis, and wherein the first portion is provided with two axially protruding male coupling means. The radially protruding male coupling means arranged on the first portion is secured in a fixed position relative to the axially protruding male coupling means whereas the second radially protruding male coupling means which is arranged on the second portion may be moved 180° about the central axis. This toy building element enables the construction of structures with integral hinge functions with a pivoting angle of up to 180°.

It is the object of the present invention to provide a toy building element that may be used for the construction of structures with rotational functions without delimitations as to angulation.

This is obtained by configuring the toy building set mentioned above as set forth in the characterising part of claim 1.

Hereby a toy building element is obtained which may, in its axial direction, be interconnected with additional toy building elements and which may also allow additional toy building elements to rotate in excess of 360° about its central portion, when said additional toy building elements are interconnected with the radially arranged coupling means.

The toy building element according to the invention preferably features two radially arranged coupling means in the same plane, each of said coupling means being able to rotate in excess of 360° about the central portion. In the preferred embodiment, the construction consists in the central portion being provided with two annular grooves that each receive a ring provided with exactly one radially arranged coupling means. Hereby a toy building element is obtained that has coupling means in the axial direction and having two radially arranged coupling means that are able to rotate about the central portion.

According to a particularly preferred embodiment, the central portion is provided with two opposed coupling means arranged axially relative to the central portion, and each of said coupling means consists of a protruding tenon with a polygonal cross section and an undercut head. This configuration of the toy building element enables a toy building element with identical coupling means (tenons) in different directions whereby it may serve as a connecting element between other toy building elements with coupling means that are complementary with the protruding tenons.

The invention will now be explained in further detail with reference to the drawings, wherein FIG. 1 illustrates a preferred embodiment of a toy building element according to the invention;

Figure 1:
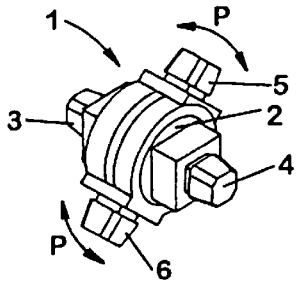

FIG. 1 illustrates a toy building element according to the invention. The toy building element 1 consists of a central portion 2 that is provided with two oppositely oriented male coupling means in the form of tenons 3 and 4 that protrude axially from the central portion 2. The tenons 3 and 4 are, in the embodiment shown, provided with substantially square cross sections whereby they are allowed to be unrotatably interconnected with other toy building elements as will appear from FIGS. 3 and 4 and as described below.

Two additional male coupling means in the form of corresponding tenons 5 and 6 are rotatably arranged about the central portion 2 as indicated by the arrows P.

Figure 2:
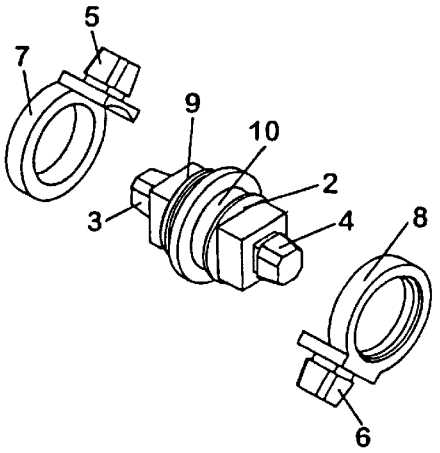
FIG. 2 illustrates the toy building element shown in FIG. 1 in its disassembled state.

FIG. 2 illustrates the toy building element 1 in its disassembled state. As will appear, the toy building element 1 consists of three portions: the central portion 2 with the tenons 3 and 4, a first annular portion 7 with the tenon 5, and a second annular portion 8 with the tenon 6.

The central portion 2 is provided with two annular grooves 9 and 10 that is able to receive the annular portions 7 and 8 that are preferably so provided that they may be snapped into the grooves 9 and 10.

In the preferred embodiment, the fitting between the annular portions 7 and 8 and the corresponding grooves 9 and 10 is relatively tight whereby a certain momentum is to be overcome in order to rotate the tenons 5 and 6 about the central portion 2. However, the fitting may also be loose whereby the tenons 5 and 6 can rotate freely about the central portion 2.

Figure 3:
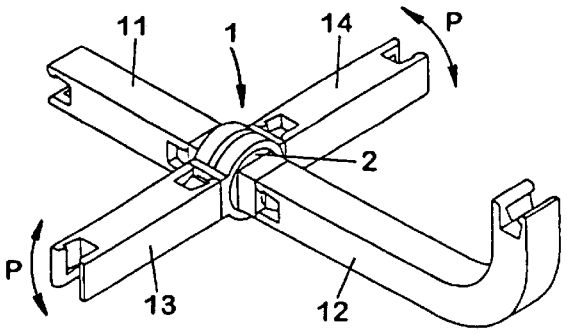
FIG. 3 illustrates the toy building element shown in FIG. 1 when interconnected with other toy building elements in a first position.

FIG. 3 illustrates the toy building element 1 when interconnected with four other toy building elements 11, 12, 13, 14 that are provided with female coupling means that are complementary to the tenons 3, 4, 5 and 6. The toy building elements 11 and 12 are interconnected with the central portion 2 of the toy building element 1 whereas the toy building elements 13 and 14 are interconnected with the rotatably arranged tenons 5 and 6.

The female coupling means on the toy building elements 11, 12, 13 and 14 are, in the embodiment shown, configured as a slot that may enter into a not more specifically defined snap-fit engagement with the tenons 3, 4, 5 and 6. As mentioned previously, each of the tenons 3, 4, 5 and 6 is provided with a substantially square cross section which means that unrotatable couplings between the toy building elements are accomplished. Thus, upon interconnecting with the tenons 3 and 4, the toy building elements 11 and 12 are secured against rotation relative to the central portion 2 of the toy building element 1. Likewise, the toy building elements 13 and 14 are secured against rotation about the tenons 5 and 6 on the toy building element 1.

On the other hand, the toy building elements 13 and 14 can be rotated about the central portion 2 as indicated by the arrows P, and due to the construction of the toy building element 1 they can rotate in excess of 360° whereby each toy building element 13 and 14 may occupy any random angulation position.

Figure 4:
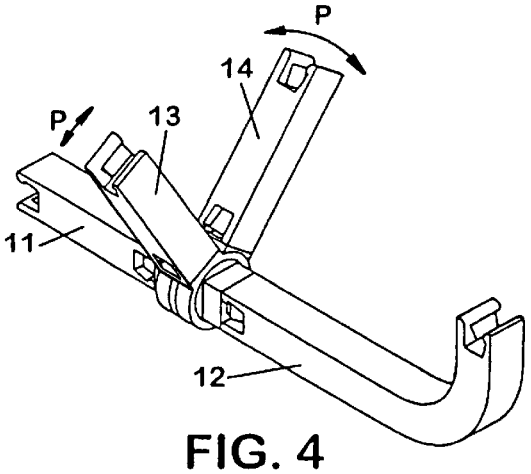
FIG. 4 illustrates the same structure as in FIG. 3, but in a second position.

Such random angulation position of the toy building elements 13 and 14 is shown in FIG. 4, where each toy building element 13 and 14 have been pivoted upwards. As indicated by the arrows P, the toy building elements 13 and 14 may occupy other random angulation positions.

Figure 5:
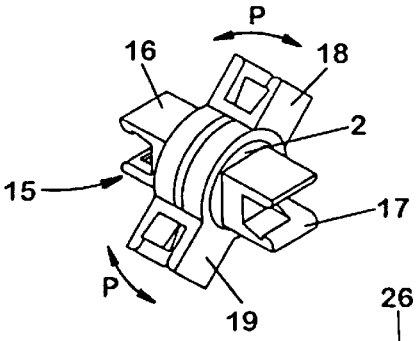
FIGS. 5–7 illustrate alternative embodiments of a toy building element according to the invention.
Figure 6:
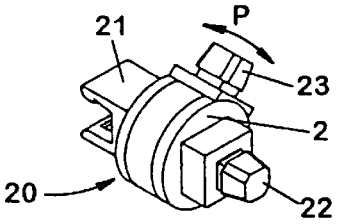
Figure 7:
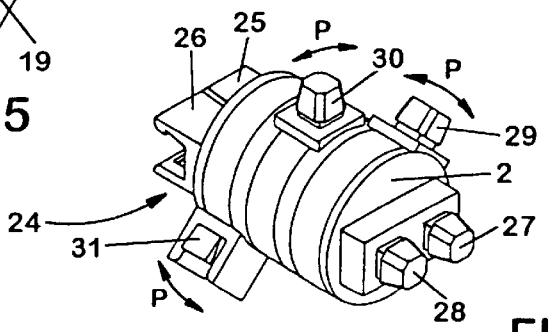

FIGS. 5–7 illustrate different alternative embodiments of the toy building element according to the invention.

FIG. 5 illustrates a toy building element 15 whose construction corresponds exactly to that of the toy building element 1 shown in FIGS. 1–4, except that the toy building element 15 is provided with female coupling means 16, 17, 18 and 19 instead of male coupling means. The toy building element 15 may therefore be interconnected with other toy building elements that are provided with complementary male coupling means, e.g. with the same configuration as the tenons 3, 4, 5 and 6 shown in FIGS. 1–4. The female coupling means 16 and 17 are arranged on the central portion 2 whereas the female coupling means 18 and 19 are rotatably arranged about the central portion as indicated by the arrows P.

FIG. 6 illustrates a second alternative embodiment of the toy building element according to the invention. The toy building element 20 is provided with a female coupling means 21 on the one side of the central portion 2 whereas a male coupling means in the form of a tenon 22 is arranged on the opposite side of the central portion 2. As opposed to the toy building elements according to the invention described above, the toy building element 20 is provided with only one rotatable coupling means, viz. the tenon 23, that is able to rotate freely about the central portion 2 as indicated by the arrow P.

A third alternative embodiment of toy building element according to the invention is shown in FIG. 7. Here the central portion 2 of the toy building element 24 is provided with two female coupling means 25 and 26 on the one side and two male coupling means in the form of tenons 27 and 28 on the other side. Furthermore, the toy building element 24 is provided with three coupling means that are rotatable about the central portion, viz. the tenons 29 and 30 and the female coupling means 31.

Other alternative embodiments of a toy building element according to the invention are perceivable, e.g. a toy building element which has coupling means on only one side of the central portion 2.

The toy building element according to the invention may be used in many contexts wherein it is desired to have a random angulation position of some toy building elements relative to others. The toy building element is useful e.g. in case a so-called transformer model is built, where one or more portions of a built structure may be caused to occupy another position by rotation about an axis and thereby fulfil another function in the structure, if desired.

Besides, the toy building element according to the invention may of course be used wherever it is desired to provide a rotational movement of some toy building elements relative to others.

I claim:

1. A toy building set comprising a first building element with a first coupling means, and a second building element with a second coupling means complementary to said first coupling means, whereby said first and second building elements can be coupled together in a releasable engagement, with said first and second coupling means the toy building set comprising a further building element with a central part provided with a selected one of said first and second coupling means arranged in an axial direction relative to said central part, and a peripheral part with another selected on of said first and second coupling means arranged in a radial direction relative to said central part, said peripheral being rotatable in excess of 360 degrees about the central part.

2. A toy building set according to claim 1, wherein two radially arranged coupling means (5, 6; 18, 19) are arranged in the same plane, each of said coupling means being able to rotate in excess of 360 degrees about the central part (2).

3. A toy building set according to claim 1, wherein the central part (2) is provided with at least one annular groove (9, 10) that may receive an annular element (7, 8) which is rotatable about the central part (2) and which is provided with at least one radially arranged coupling means (5, 6; 18, 19; 23; 29, 30, 31).

4. A toy building set according to claim 3, wherein the central part (2) is provided with two annular grooves (9, 10) that each receives an annular portion (7, 8) provided with exactly one radially arranged coupling means (5, 6; 18, 19).

5. A toy building set according to claim 1, wherein the central part (2) is provided with two opposed coupling means (3,4; 16, 17; 21, 22) arranged axially relative to the central part (2).

6. A toy building set according to claim 1, wherein each of the coupling means consists of a protruding tenon.

7. A toy building set according to claim 6, wherein each protruding tenon has a polygonal cross section and is provided with an undercut head.

* * * * *